US011131271B2

(12) United States Patent
Lindström et al.

(10) Patent No.: US 11,131,271 B2
(45) Date of Patent: Sep. 28, 2021

(54) CARBURETOR SYSTEM FOR A CARBURETOR ENGINE

(75) Inventors: Fredrik Lindström, Huskvarna (SE); Pär Martinsson, Jönköping (SE); Magnus Ottosson, Norrahammar (SE); Rikard Rydberg, Tenhult (SE)

(73) Assignee: HUSQVARNA AB, Huskvarna (SE)

( * ) Notice: Subject to any disclaimer, the term of this patent is extended or adjusted under 35 U.S.C. 154(b) by 295 days.

(21) Appl. No.: 14/110,604

(22) PCT Filed: Apr. 15, 2011

(86) PCT No.: PCT/SE2011/050464
§ 371 (c)(1),
(2), (4) Date: Oct. 8, 2013

(87) PCT Pub. No.: WO2012/141633
PCT Pub. Date: Oct. 18, 2012

(65) Prior Publication Data
US 2014/0026854 A1 Jan. 30, 2014

(51) Int. Cl.
*F02M 17/00* (2006.01)
*F02M 1/16* (2006.01)
(Continued)

(52) U.S. Cl.
CPC ..... *F02M 1/16* (2013.01); *F02M 17/04* (2013.01); *F02B 63/02* (2013.01)

(58) Field of Classification Search
CPC ..... F02B 61/045; F02B 63/02; F02M 17/04; F02M 63/0225; F02M 31/20;
(Continued)

(56) References Cited

U.S. PATENT DOCUMENTS 3,598,507 A * 8/1971 Volt et al. ..... 417/505
4,271,093 A 6/1981 Kobayashi
(Continued)

FOREIGN PATENT DOCUMENTS

CN 101048586 A 10/2007
EP 1277944 A1 1/2003
(Continued)

OTHER PUBLICATIONS

International Search Report and Written Opinion of PCT/SE2011/050464 dated Dec. 29, 2011, all enclosed pages cited.
(Continued)

*Primary Examiner* — Gonzalo Laguarda
(74) *Attorney, Agent, or Firm* — Burr & Forman, LLP

(57) ABSTRACT

A fuel supply system for small two-stroke internal combustion engines for e.g. chain saws, line trimmers and similar hand-held power-tools including a diaphragm carburetor (20) equipped with a purging system (80*a*, 81*a*) or priming system (80*b*, 81*b*) for facilitating starting of the engine (1). Downstream of the diaphragm (30), the carburetor has a fuel valve (60) with a fuel cavity (73), which when the valve is not closed being connected via a fuel conduit (37) to a fuel nozzle (35, 36) in a main air passage (21) in the carburetor. The purging system or priming system including a fuel line (80*a*; 80*b*), which is provided with a manually operated pump (81*a*; 81*b*) and is connected between a fuel tank (26) and either the fuel cavity (73) or the fuel conduit (37).

18 Claims, 10 Drawing Sheets

(51) Int. Cl.
*F02M 17/04* (2006.01)
*F02B 63/02* (2006.01)

(58) Field of Classification Search
CPC ..... Y02T 10/126; Y02T 10/36; Y02T 10/121; Y02T 10/32; F02D 19/081; F02D 19/0647; F02D 19/0665; F02D 19/0678; F02D 33/006; F02D 37/02; Y10S 261/68
USPC ..... 123/437
See application file for complete search history.

(56) References Cited

U.S. PATENT DOCUMENTS 4,466,412 A 8/1984 McChesney et al.
4,903,655 A * 2/1990 Vonderau et al. ..... 123/198 C
5,181,488 A * 1/1993 Sakurai ..... 123/179.11
5,560,345 A 10/1996 Geyer et al.
5,636,617 A 6/1997 Shuichi
5,891,369 A 4/1999 Tuggle et al.
6,123,322 A * 9/2000 Sasaki ..... F02M 3/10 261/35
6,354,571 B1 3/2002 Gerhardy
6,374,810 B1 4/2002 Pattullo
6,533,254 B1 3/2003 Grifka et al.
7,237,530 B2 7/2007 Miyanoo et al.
7,690,342 B2 4/2010 Gliniecki et al.
8,950,381 B2 * 2/2015 Larsson ..... F02D 9/1055 123/457
2002/0195726 A1 * 12/2002 Galka et al. ..... 261/35
2004/0036184 A1 2/2004 Nonaka
2006/0219225 A1 * 10/2006 Pattullo ..... 123/516

FOREIGN PATENT DOCUMENTS

JP S5569748 A 5/1980
JP S5920551 A 2/1984
JP 08028368 A 1/1996
JP H09190487 A 7/1997
JP H10131807 A 5/1998
JP 2003120421 A 4/2003
JP 2003254162 A 9/2003
WO 2009116902 A1 9/2009

OTHER PUBLICATIONS

Chapter I International Preliminary Report on Patentability of PCT/SE2011/050464 dated Oct. 15, 2013, all enclosed pages cited.

* cited by examiner

CARBURETOR SYSTEM FOR A CARBURETOR ENGINE

TECHNICAL FIELD

The present invention relates to a fuel supply system of an internal combustion engine including a carburetor with a main air passage, the carburetor having a fuel pump supplying fuel to a fuel regulator from a fuel tank, said fuel supply system further including a fuel valve for controlling delivery of fuel to a main air passage of a carburetor of an internal combustion engine, the fuel valve including at least one inlet port for receiving fuel from a fuel regulator of the carburetor, at least one fuel outlet port for connecting to at least one nozzle in the air passage leading into the engine, a fuel cavity between the inlet port and the outlet port, and a valve member movable in a manner so as to enable at least two states, a first state permitting flow of fuel from the inlet port through the cavity to the outlet port of the valve, and a second state at least principally blocking such flow.

It also relates to a hand held tool powered by a two stroke crank case scavenged internal combustion engine including said fuel supply system.

It further relates to a fuel valve for controlling delivery of fuel to a main air passage of a carburetor of an internal combustion engine, the fuel valve including at least one inlet port for receiving fuel from a fuel regulator of the carburetor, at least one fuel outlet port for connecting to at least one nozzle in the air passage leading into the engine, a fuel cavity between the inlet port and the outlet port, and a valve member movable in a manner so as to enable at least two states, a first state permitting flow of fuel from the inlet port through the cavity to the outlet port of the valve, and a second state at least principally blocking such flow.

It further relates to a carburetor having an integral fuel valve or a fuel valve that connects to the exterior of the carburetor.

It also relates to a method for facilitating starting of an internal combustion engine including a carburetor with a main air passage, the carburetor having a fuel pump supplying fuel to a fuel regulator from a fuel tank, said fuel supply system further including a fuel valve for controlling delivery of fuel to a main air passage of the carburetor, the fuel valve including at least one inlet port for drawing fuel from a fuel regulator of the carburetor, at least one fuel outlet port for connecting to at least one nozzle in the air passage leading into the engine, a fuel cavity between the inlet port and the outlet port, and a valve member movable in a manner so as to enable at least two states, a first state permitting flow of fuel from the inlet port through the cavity to the outlet port of the valve, and a second state at least principally blocking such flow.

BACKGROUND ART

Hand held power-tools such as, but not limited to, chain saws and line trimmers, are often powered by small two stroke internal combustion engines that are equipped with diaphragm carburetors. Generally, a diaphragm carburetor has a main air passage where fuel and air is mixed in a correct ratio. An outlet of the main air passage leads to a crankcase of the engine. Typically, a throttle valve is provided in the main air passage to control the amount of fuel and air mixture that enters the crankcase.

Usually, before starting an engine, either a purging system or a priming system is actuated at least once to introduce fresh fuel into the carburetor. Typically, the purging system is used to remove residual air or fuel from the carburetor and fill desired fuel passages and chambers of the carburetor with the fresh fuel, whereas the priming system is used to inject a small quantity of fuel into the air passage. However, such priming system may also be used in addition to performing the functions of a purging system. The fresh fuel supplied to the carburetor before starting the engine facilitates starting of the engine. The purging system and the priming system are typically actuated by a purge bulb and a primer bulb, respectively.

However, after having stored the apparatus after even a very short use, the gasoline component of the two-stroke fuel evaporates and the two-stroke oil component of the fuel is left. This oil can cause sticking and clogging between movable parts, and it may even block small fuel bores. In carburetors having a fuel valve, it may even prevent the fuel valve from opening if closed. However, the oil is easily dissolved when it comes in contact with fresh fuel.

When shutting down the engine many hand held tools set the fuel valve in a closed state. Thereby, fuel leakage through the main and/or idle nozzle is prevented while the tool is stored. If the fuel valve is stuck in this state due to the evaporation of the fuel as described above, it may be difficult or even impossible to start the engine by pulling the cord, since the closed fuel valve blocks any fuel delivery to the main air passage. Even if the fuel valve is partly open the user of the apparatus may have to pull the start cord of the engine repeatedly for a long time until fresh fuel has dissolved the oil residue and the fuel can continue to flow. Many users may experience this as if the apparatus were faulty and will not start at all. Actually, a user may even experience problems when trying to start a brand new product for the first time.

A carburetor of the kind referred to above is disclosed in WO 2009/116902 A1, for example, but does not deal with the sticking/clogging problem.

Further, carburetors of two stroke engines for chainsaws, trimmers and weed cutters and the like apparatus usually have air purging systems. For instance, U.S. Pat. No. 4,271,093 discloses an air purging system and U.S. Pat. No. 6,374,810 B discloses a combined priming and purging system, but they are applied in carburetors of another kind than the one referred to above and do not have a fuel valve with a moveable valve member that may experience sticking/clogging problem.

In addition, when prior art diaphragm carburetors have been equipped with an air purging system, such systems have been connected to a fuel metering chamber in the carburetor. In a diaphragm carburetor having a fuel valve provided downstream of the fuel metering chamber, a connection of the systems to the fuel metering chamber will not accomplish an efficient air purging.

SUMMARY OF THE INVENTION

A first object of the present invention is to provide a fuel supply system, which reduces the risk of having moveable parts such as a valve member stuck in one position, and that provides good supply of fuel to an engine using the fuel supply system.

In a fuel supply system of the kind referred to in the first paragraph above, this object is achieved with a fuel line connecting said carburetor to said tank and the fuel line being provided with a manually operated purge pump, wherein the fuel line directly connects to the fuel valve or to a fuel conduit between the fuel valve and the nozzles, permitting the purge pump to draw fuel from the inlet through the cavity and optionally returning it to the fuel tank, thereby extracting air possibly present as well as wetting interior surfaces of the cavity with fuel.

To minimize the volume of fuel that has to be drawn off by purging prior to starting the engine, the fuel line section between the purge pump and the fuel cavity or fuel conduit downstream of the outlet port of the valve suitably is of minimum length.

In a fuel supply system of the kind referred to in the first paragraph above, this first main object is also achieved with a fuel line connecting said carburetor to said tank and the fuel line being provided with a manually operated primer pump, wherein the fuel line directly connects to the fuel valve, or to a fuel conduit between the fuel valve and the nozzle, or to the fuel regulator, or to a duct between the fuel regulator and the fuel valve, permitting the primer pump to deliver fuel from the fuel tank to the fuel cavity, either directly, or backwards from the outlet port, or forwardly from the inlet port, thereby wetting interior surfaces of the cavity with fuel.

To ensure that the fuel in the various lines and conduits flows only in the desired direction, it is preferred that a first and a second check valve are provided in the fuel line provided with the purge pump or primer pump, and preferably arranged inside the purge pump or primer pump. Further, it is preferred that a third and a fourth check valve are provided downstream of the outlet port and downstream of the possible connection between the fuel line (with the purge pump or primer pump) and the fuel conduit, such that the fourth check valve is provided in a conduit leading to a main nozzle and the third check valve in a branch conduit leading to at least one idle nozzle.

Another object is to provide a hand held power tool that can easily be started, and which reduces the risk of having moveable parts such as a fuel valve member stuck in one position. This object is achieved by a hand held power tool having the fuel supply system referred to above.

Another object of the invention is to provide a fuel valve suitable for such fuel supply system. In a fuel valve of the kind referred to in the third paragraph above, this objects is achieved in that the fuel valve has a pump port communicated with the fuel cavity, wherein said pump port is intended to be connected to a manually operated pump.

Another object is to provide a carburetor suitable for such fuel supply system. In a carburetor of the kind referred to in the fourth paragraph above, this object is achieved by using a fuel valve of the kind referred to in the third paragraph above that has a pump port communicated with the fuel cavity, wherein said pump port is intended to be connected to a manually operated pump.

Another object is to provide a fuel supply system which provides for less effort and/or less difficulty associated with starting of an internal combustion engine. This object is achieved with the fuel supply system as referred to above for which a fuel line with a purge or primer pump is connected to a fuel conduit or duct or a fuel valve at a position between a metering chamber and a main air passage of a carburetor, i.e. downstream of the metering chamber and upstream of fuel nozzles in the main air passage. Thereby, passageways and/or cavities for communicating the metering chamber with the main air passage or at least interior surfaces thereof will be wetted with fuel upon purging or priming. This implies that fuel needs to travel a shorter distance upon starting of the engine as compared to having the fuel line with the purge pump directly connected to the metering chamber. Consequently, upon starting the engine, smaller effort/difficulty and/or shorter time is required for having fuel entering the engine in case the fuel in said duct/conduit/fuel valve has evaporated. In case the engine is provided with a recoil starter, possibly less start pulls will then be required for starting the engine.

Another object of the present invention is to provide a method for facilitating starting of a carburetor engine, by means of which method fresh fuel is made to flow past and dissolve the oil residue causing sticking and clogging between movable parts and possibly even blocking small fuel bores.

In a method of the kind referred to in the fifth paragraph above, this second main object is achieved by drawing fuel from the inlet port either directly through the cavity or alternatively downstream the fuel outlet port, and returning it to the fuel tank, so as to extract air possibly present as well and to wet interior surfaces of the cavity with fuel.

When alternatively drawing fuel through the fuel conduit, the valve member at start up of the engine preferably being arranged to be offset from the state at least principally blocking fuel flow and/or being adapted to have a leak flow past the valve member when the valve member is in the state at least principally blocking fuel flow.

Preferably, the drawing of fuel is carried out by connecting the fuel cavity to the tank, either directly or indirectly through the fuel conduit, by a fuel line having a purge pump, and operating the purge pump to draw fuel from the inlet through the cavity and return it to the fuel tank, so as to extract air possibly present as well as to wet interior surfaces of the cavity with fuel.

In a method of the kind referred to in the fifth paragraph above, this object is also achieved by delivering fuel from the fuel tank to the fuel cavity either directly, or backwards by injecting fuel downstream the fuel outlet port, or forwardly by injecting fuel upstream the inlet port, so as to wet interior surfaces of the cavity with fuel.

BRIEF DESCRIPTION OF THE DRAWINGS

In the following, the invention will be described in more detail with reference to preferred embodiments and the appended drawings.

MODES FOR CARRYING OUT THE INVENTION

Figure 1:
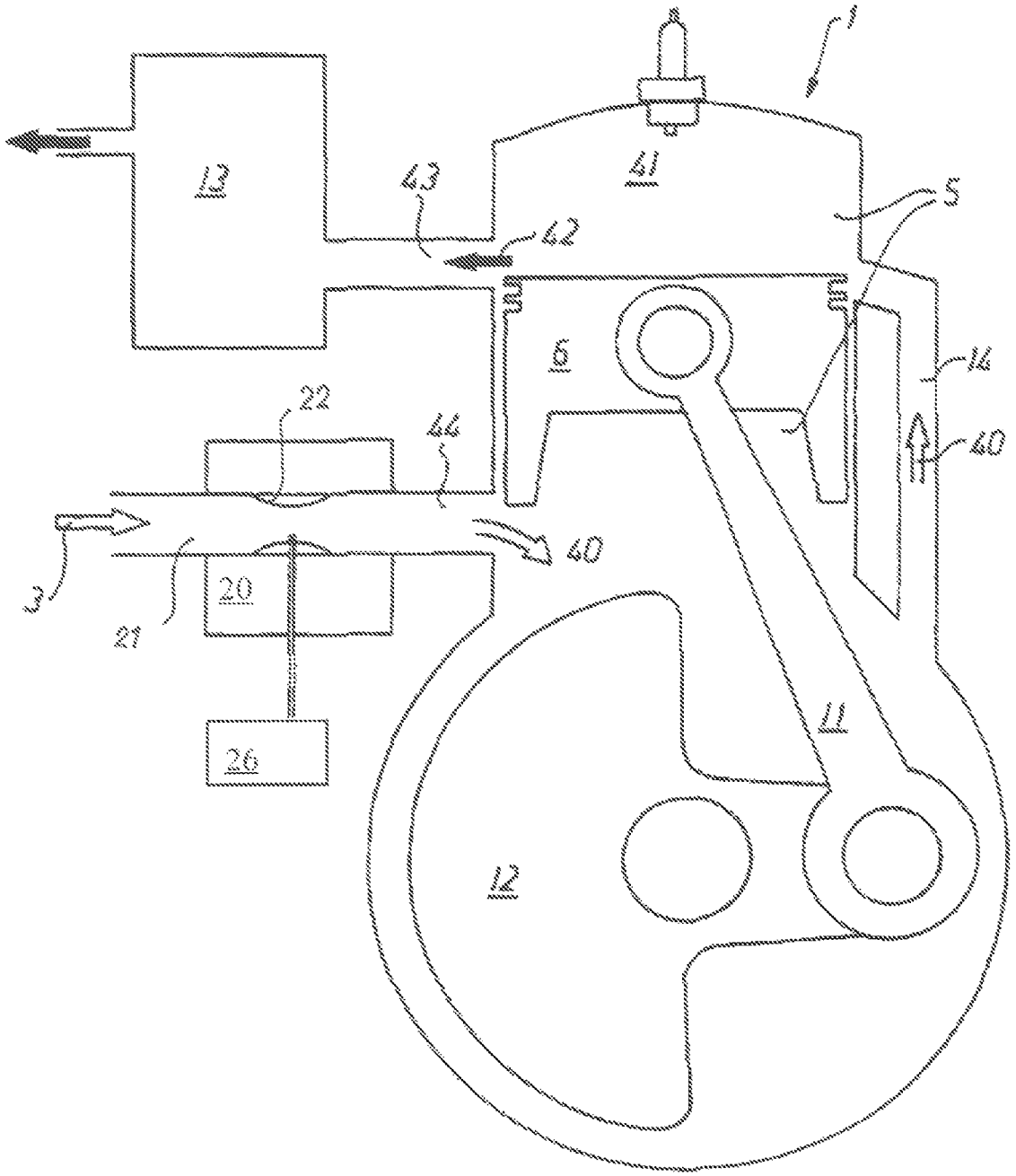
FIG. 1 is a schematic cross sectional view of a two-stroke engine connected to a fuel delivery system.

In the schematic FIG. 1, reference numeral 1 designates an internal combustion engine 1 of a two-stroke type. It is crankcase scavenged, i.e. a mixture 40 of air 3 and fuel from a fuel delivery system 20 (e.g. a carburetor or a low pressure fuel injection system) is drawn to the engine crankcase. From the crankcase, the mixture is carried through one or several scavenging passages 14 up to the engine combustion chamber 41. The chamber is provided with a spark plug igniting the compressed air-fuel mixture. Exhausts 42 exit through the exhaust port 43 and through a silencer 13. The engine 1 has a cylinder 5 with a reciprocating piston 6, which by means of a connecting rod 11 is attached to a crankshaft 12 equipped with a counterweight. In this manner the crankshaft is rotated. In FIG. 1, the piston 6 assumes an intermediate position, wherein flow is possible both through an intake port 44, through the scavenging passage 14, and the exhaust port 43. The fuel delivery system 20 has a main air passage 21 for the mixture of air and fuel. The mouth of the main air passage 21 into the cylinder 5 is called intake port 44. Thus, the main air passage 21 is closed by the piston 6. By opening and closing the intake port 44, varying flow speeds and pressures are created inside the main air passage 21. These variations largely affect the amount of fuel supplied when the fuel delivery system 20 is of carburetor type. Since a carburetor has an insignificant fuel feed pressure, the amount of its fuel feed is entirely affected by pressure changes in the main air passage 21. Thus the supplied amounts of fuel are essentially affected by the varying flow speeds and pressures inside the main air passage 21 that are caused by the opening and the closing of the latter. In addition, since the crankcase in crankcase scavenged two stroke engines or crankcase scavenged four stroke engines can hold a considerable amount of fuel and consequently serve as a leveling reservoir, it is not necessary to adjust the fuel delivery for each revolution, i.e. adjusting the fuel delivery in one revolution will affect subsequent revolutions. All these features are entirely conventional in an crank case scavenged internal combustion engine and for this reason they will not be described herein in any closer detail.

Figure 2:
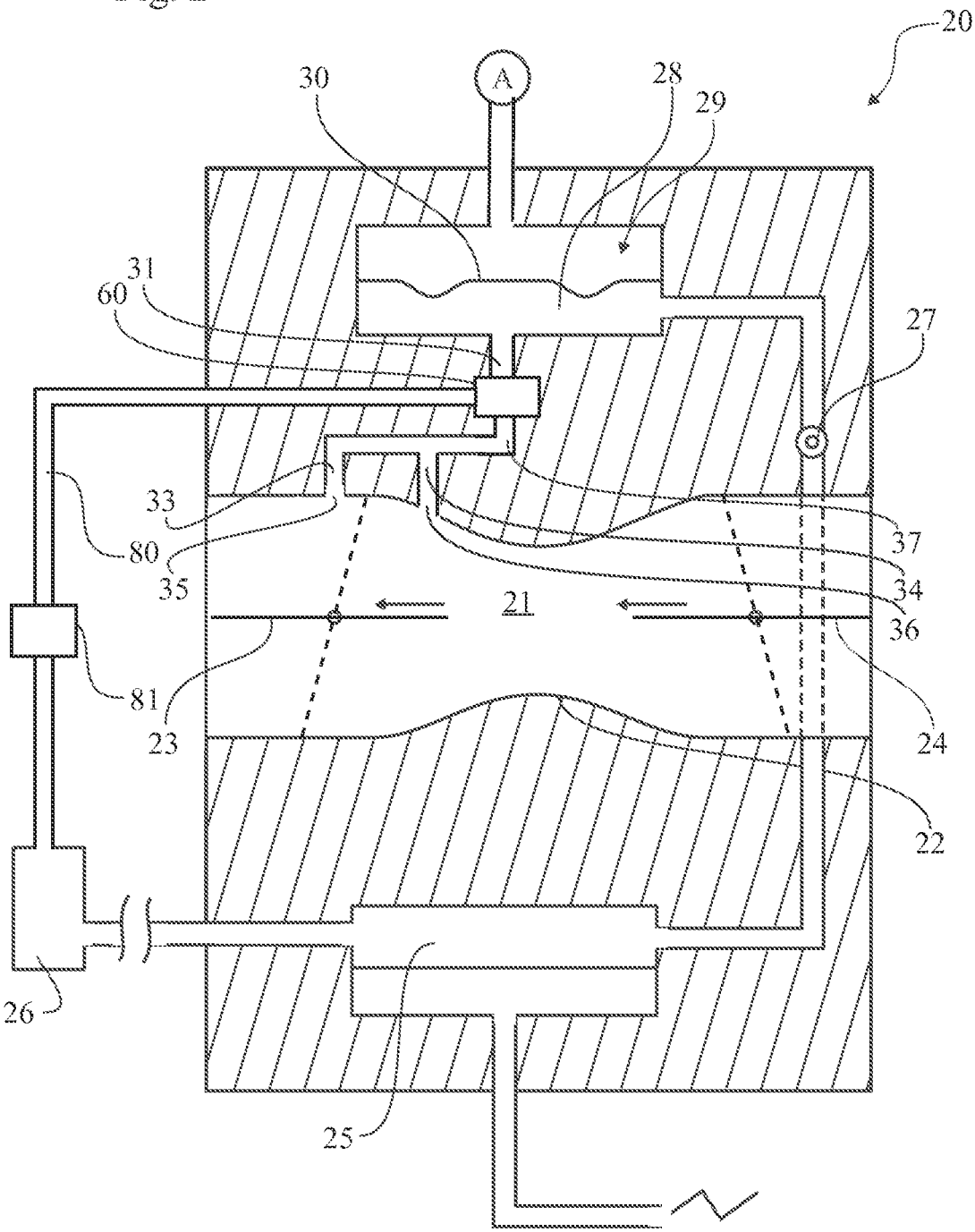
FIG. 2 is a schematic cross sectional view of the fuel delivery system including a carburetor provided with an air purge/primer system in accordance with an embodiment of the present invention.

FIG. 2 illustrates a fuel delivery system 20 of carburetor type. The carburetor 20 has an intake passage or main air passage 21 with a constriction 22 giving Venturi effect. A throttle valve 23 and a choke valve 24 are mounted in the main air passage 21. The carburetor further includes a fuel pump 25, which draws fuel from a fuel tank 26.

Preferably, the fuel pump 25 is a pulsation controlled diaphragm pump, driven by the pressure pulses generated by the crankcase of the engine 1. The fuel then passes through a needle or float valve 27 that is controlled by the diaphragm 30 of a fuel regulator 29 and enters a fuel metering chamber 28 of a fuel regulator 29. The fuel metering chamber 28 is separated from atmospheric pressure by the diaphragm 30 and can hold a predetermined amount of fuel. A duct 31, from fuel metering chamber 28, leads to a fuel valve 60. Preferably, the fuel valve 60 is an electrically controlled bistable valve, operating between two states, open and closed. An example of such valve is shown in WO 2009/116902 A1. The fuel valve 60 opens or closes the interconnection between the fuel metering chamber 28 and two fuel lines 33, 34 of different widths leading to the intake passage 21. The narrower channel 33 leads to at least one idle nozzle 35 in the area of the throttle valve 23, at least one nozzle 35 downstream of the throttle valve 23, and the wider channel 34 leads to a main nozzle 36 located upstream the throttle valve 23 and preferably at or downstream the Venturi 22. Due to the varying pressures in the main air passage 21 as the engine operates, fuel is drawn from the fuel metering chamber 28 through the main nozzle 36 and the idle nozzle 35, of course, depending on whether the fuel valve 60 is closed or open. The fuel lines 33, 34 are preferably provided with corresponding check valves 84, 85.

Figure 5:
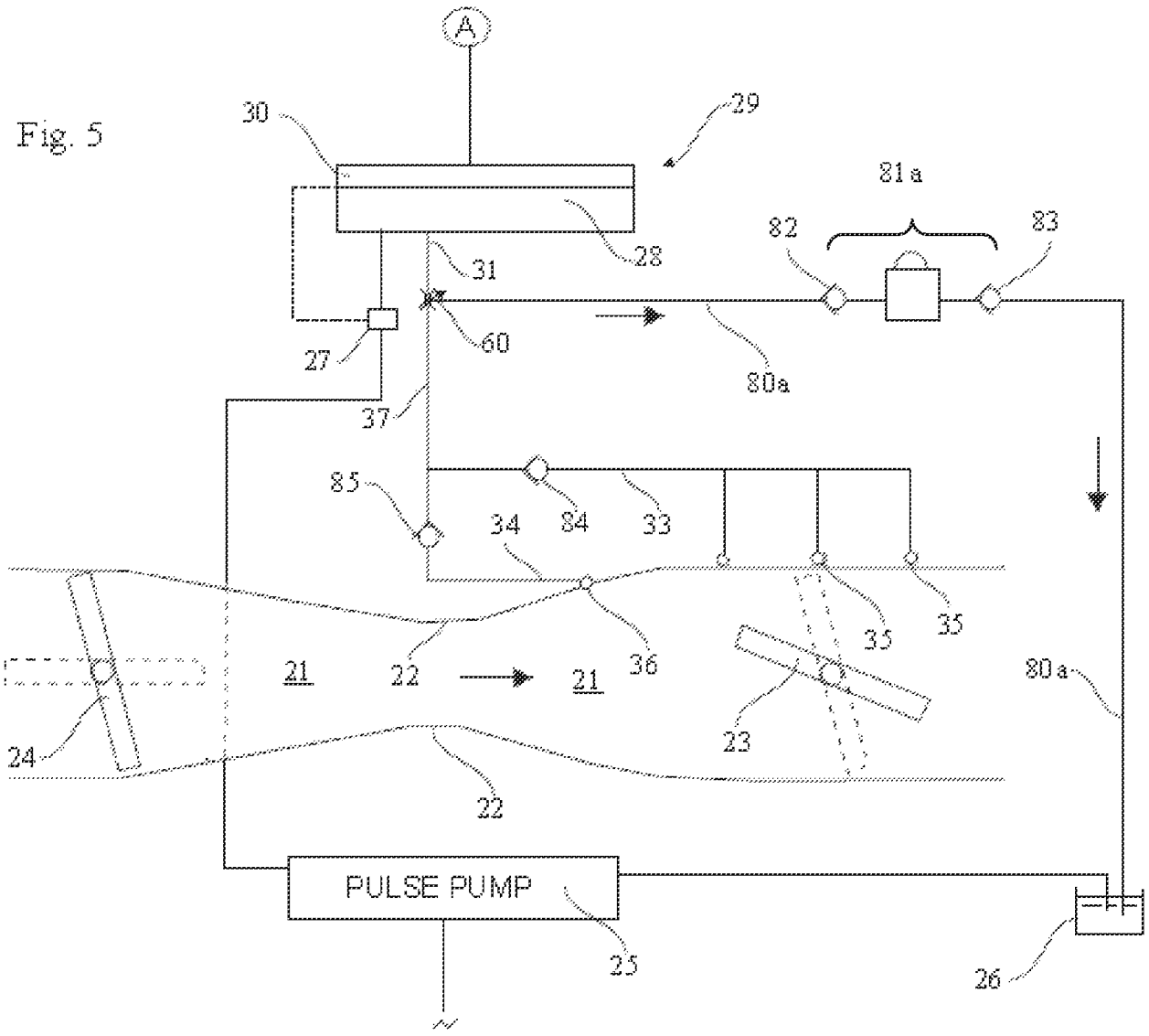
FIG. 5 is a flow scheme of the fuel and air purge systems in accordance with a first embodiment of the present invention.
Figure 6:
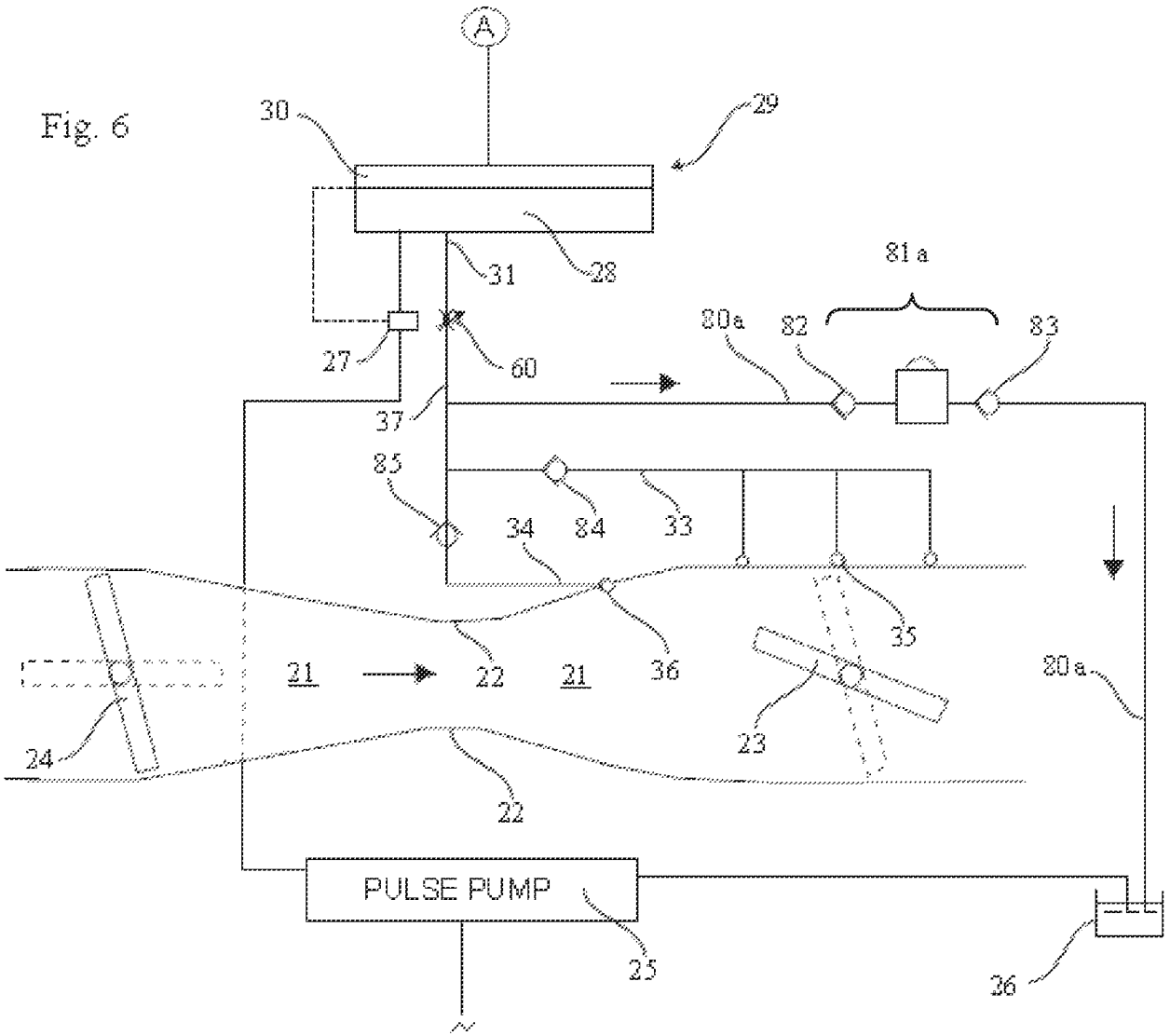
FIG. 6 is a flow scheme of the fuel and air purge systems in accordance with a second embodiment of the present invention.
Figure 7:
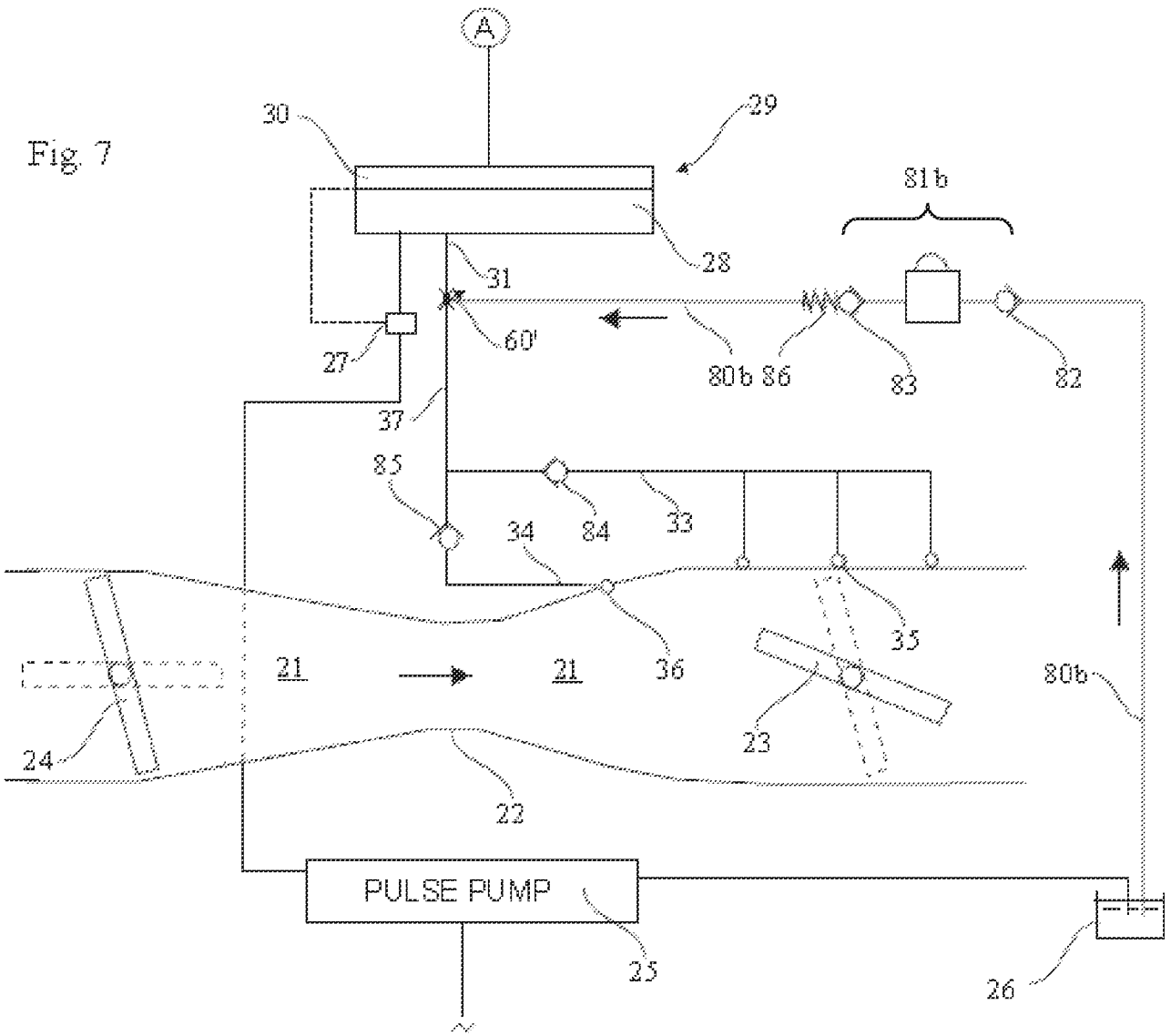
FIG. 7 is a flow scheme of the fuel and primer systems in accordance with a third embodiment of the present invention.

A fuel line generally designated 80 including a manually operated pump generally designated 81 is connected between fuel valve 60 and the fuel tank 26, as also seen in FIGS. 5, and 7. Alternatively the fuel line 80 can connect upstream or downstream the fuel valve 60 as will be described in relation to FIGS. 6, 8 and 9.

In a first and second embodiment shown in FIGS. 5, 6 the pump 81 operates as a purge pump 81*a* that vents trapped air from the system while wetting the fuel valve 60 with fuel.

Figure 8:
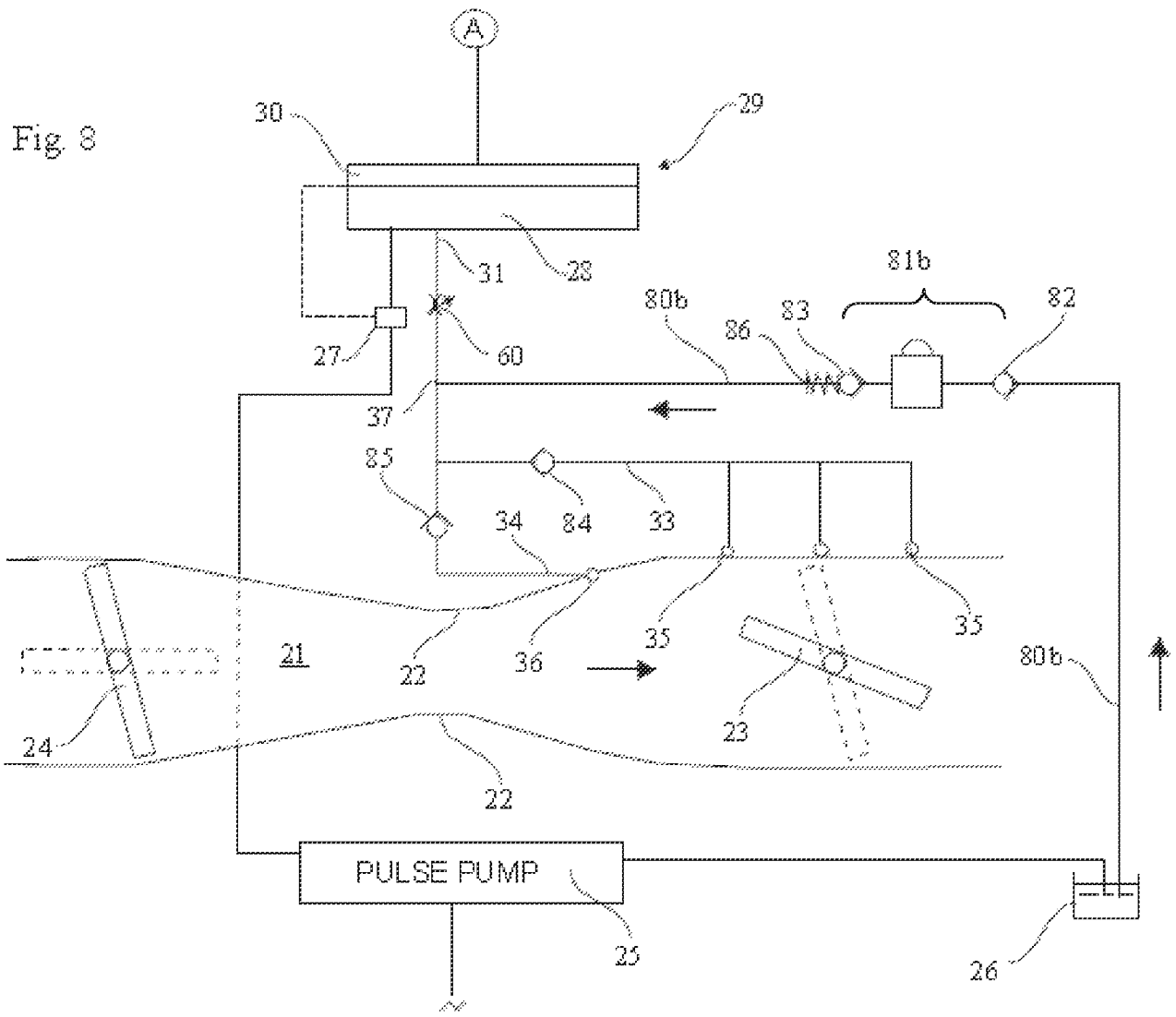
FIG. 8 is a flow scheme of the fuel and primer systems in accordance with a fourth embodiment of the present invention.
Figure 9:
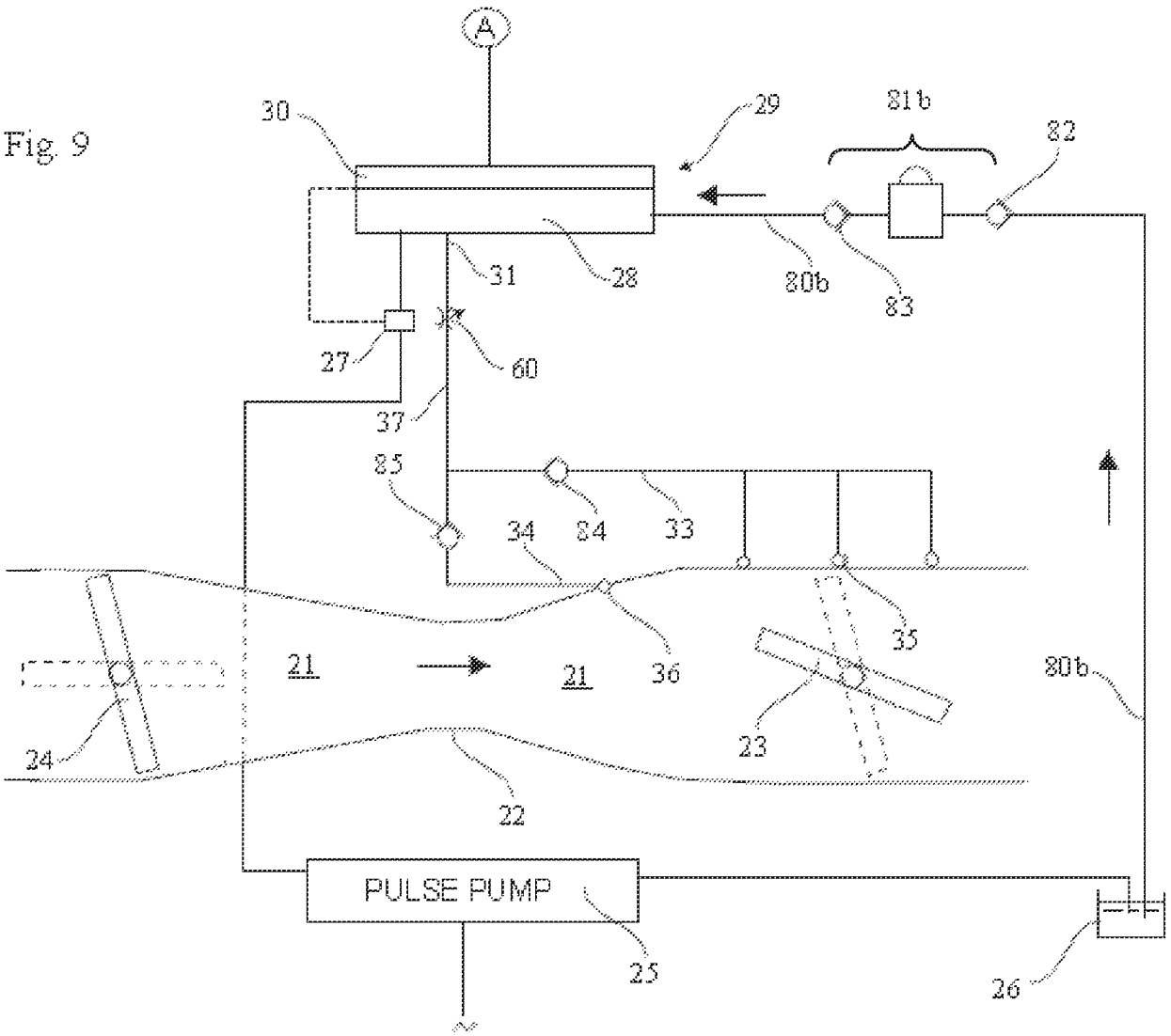
FIG. 9 is a flow scheme of the fuel and primer systems in accordance with a fifth embodiment of the present invention.

And in a third, fourth and fifth embodiment shown in FIGS. 7, 8, 9 the pump 81 operates in the opposite direction, i.e. as a primer pump 81*b*, supplying fuel to the fuel valve 60.

To provide the desired direction of fuel flow through the purge pump 81*a* and the primer pump 81*b*, both of them preferably have two check valves incorporated in the pump design, one 82 upstream and the other 83 downstream of an elastic bulb. However, if desired, both of the check valves 82 and 83 may be provided as separate components. The check valves are not limited to a particular kind of check valve, but could be of many different kinds including ball check valves, duckbill valves etc. Specifically, the check valve may include a weighted body of any suitable form coupled to a resilient member, such as a compression or expansion spring.

The fuel valve 60 is preferably controlled by an electronic control unit, not shown, but described in WO 2009/116902 A1. The control unit receives sensor inputs such as throttle position from at least one throttle positions sensor, not shown, engine speed data from at least one engine speed sensor, not shown, and optionally inputs from additional sensor/s, not shown, e.g. temperature sensor/s. The electronic control unit can use the sensor inputs to control the air to fuel ratio, e.g. decide when to open or close the fuel valve 60.

Figure 3:
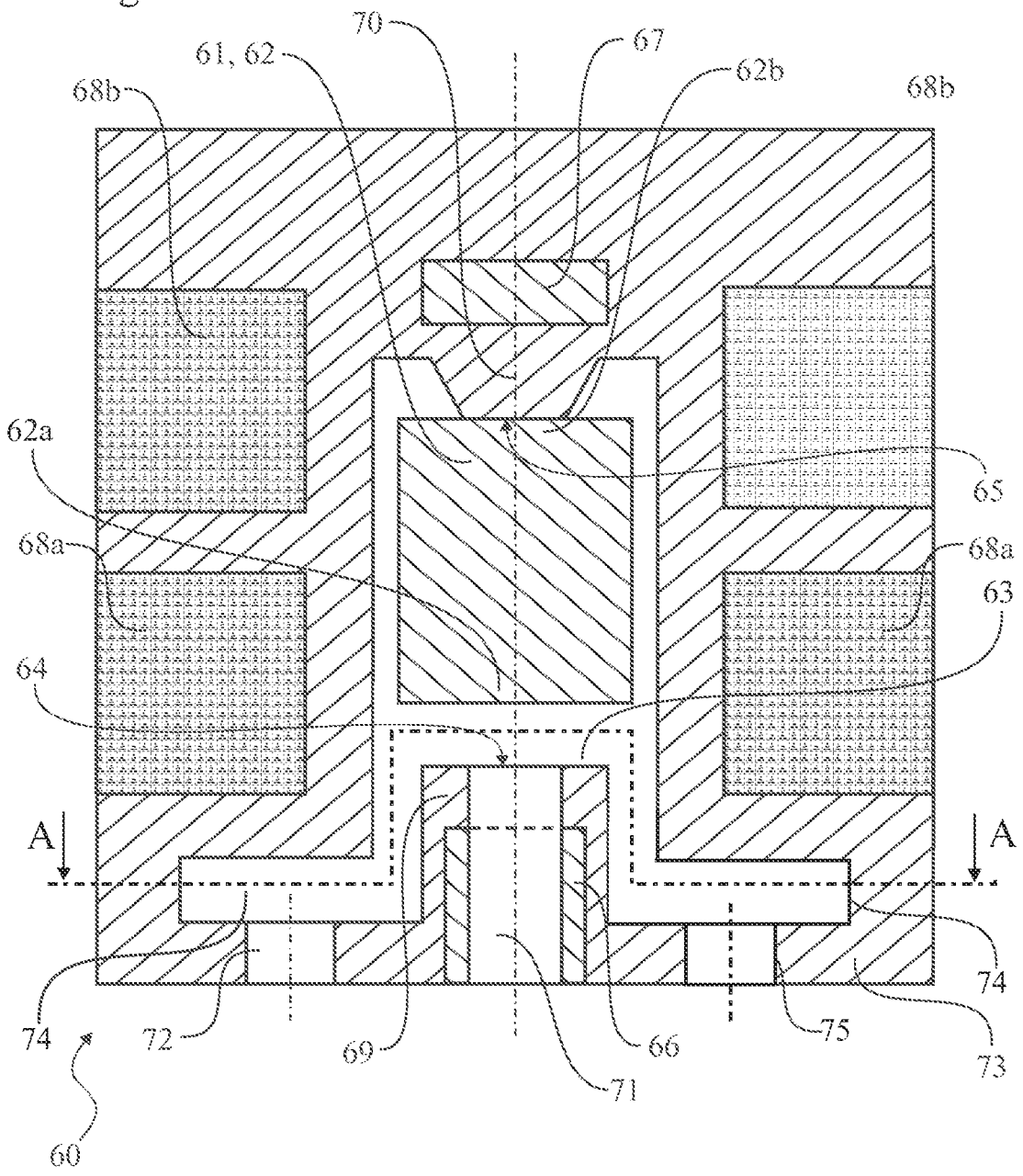
FIG. 3 is a schematic cross sectional view of a fuel valve having a port for connecting to the air purge/primer system shown in FIG. 2.
Figure 4:
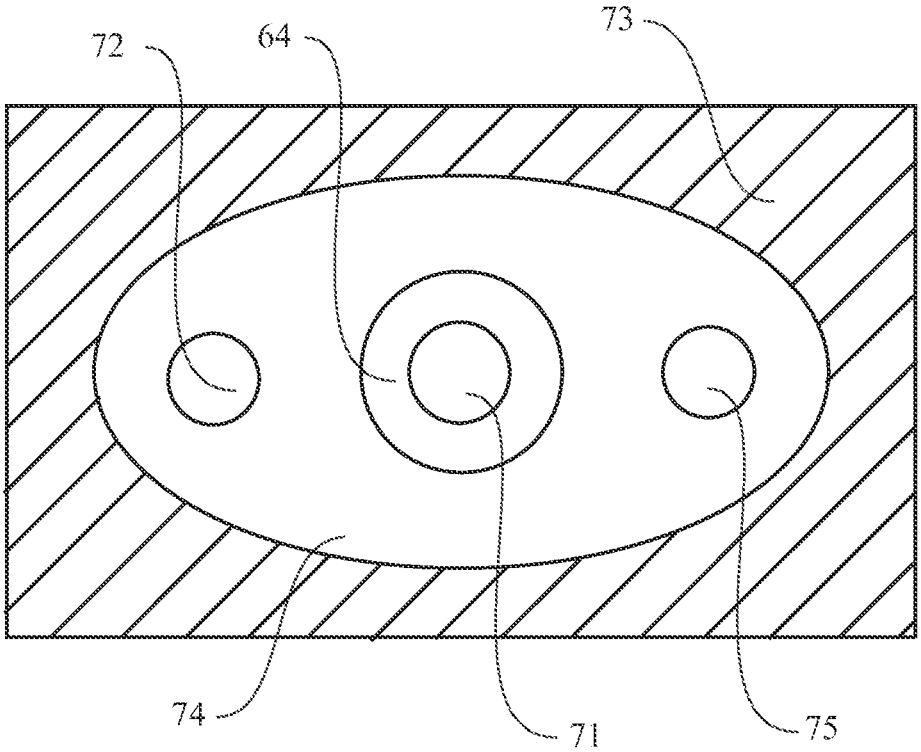
FIG. 4 is a schematic cross sectional view of a fuel valve of FIG. 3 taken along line A-A.

The fuel valve 60 shown in FIGS. 3, 4 includes a valve body 73 with an axially extending generally cylindrical chamber 63, a moveable valve member in the shape of a plunger 61 that is axially moveable in the chamber 63 and includes a permanent magnet 62. Further, the fuel valve 60 includes electromagnetically operating means 68*a*, 68*b* for exerting a magnetic force to snap the plunger 61 between a forward and a rearward position (i.e. moving the plunger between an open and a closed state) when energized, and two ferromagnetic elements 66, 67, one at each axial end of the chamber 63.

The axially extending chamber 63 extends in a direction away from the main air passage 21 of the carburetor and has two valve seats 64, 65 that are located opposite each other and limit the axial movement of the plunger 61, namely a front valve seat 64 at a front axial end facing the intake passage 21, and a rear valve seat 65 at the opposite rear axial end. At the front end there are also provided two ports, viz. a first port 71 and second port 72, one of them 72 functioning as an inlet port to the fuel valve and the other 71 as an outlet port from the fuel valve 60. The ports 71, 72 are fluidly connected to one another when the fuel valve 60 is open, forming a cavity-shaped fluid passage 74 between them. If desired, a leak passage, not shown, may be provided to permit a minor leakage of fuel past the valve set 64 when the fuel valve 60 is closed.

The first port 71, preferably the outlet, is a channel of circular cross-section and is located as an opening in the front valve seat 64 and connects through a fuel conduit 37 that branches to form the fuel lines 33 and 34 that lead to the Venturi constriction 22. The front end of the plunger 61 has a cross-section adapted to close the opening of the first port 71.

The second port 72, preferably the inlet, is located beside the front valve seat 64, and connects to the duct 31 from fuel metering chamber 28.

At each valve seat 64, 65 there is a ferromagnetic element 66, 67, viz. a front ferromagnetic element 66 and a rear ferromagnetic element 67, preferably in the form of iron cores. These ferromagnetic elements 66, 67 serve to provide two stable valve states, viz. an open state when the plunger 61 abuts the rear valve seat 65 and a closed state when the plunger 61 abuts the front valve seat 64. At the closed state, the front end of the plunger 61 closes the first port 71 at the front valve seat 64, preventing fluid from flowing between the first 71 and the second port 72, disregarding any possible desired minor leakage if a leak passage, not shown, is provided.

The front ferromagnetic element 66 at least partly surrounds the channel of the first port 71, preferably in a form of an iron tube around the channel, i.e. the front ferromagnetic element 66 preferably provides a section of the channel of the first port 71.

The magnet 62 of the plunger 61 constitutes at least a section of the plunger 61; preferably the entire plunger 61 is a magnet 62. The magnet 62 of the plunger 61 is magnetically oriented in the axial direction, having a front magnetic pole 62*a*, which faces the front valve seat 64 and interacts with the front ferromagnetic element 66, and a rear magnetic pole 62*b* that faces the rear valve seat 65 and interacts with the rear ferromagnetic element 67. The magnetic forces between the magnet 62 and the ferromagnetic element 66, 67, respectively, are controlled so that the magnetic force between the front pole 62*a* and the front ferromagnetic element 66 is stronger than the magnetic force between the rear pole 62*b* and the rear ferromagnetic element 67, when the plunger 61 abuts the front valve seat 64, and so that the magnetic force between the rear pole 62*b* and the rear ferromagnetic element 67 is stronger than the magnetic force between the front pole 62*a* and the front ferromagnetic element 66, when the plunger 61 abuts the rear valve seat 65.

The magnetic forces between the magnet 62 and the ferromagnetic element 66, 67, respectively, are controlled by distancing them from direct contact with one another, by separating them through a front and a rear non-magnetic material 69, 70, respectively, of the front and rear valve seats 64, 65, respectively. The main reason for this is to avoid direct contact between anyone of the ferromagnetic elements 66, 67 and the magnet 62, since the magnetic force between a ferromagnetic element and a magnet grows exponentially the closer they are. Hence, by spacing them apart, the slope of the force curve between them is not as steep as if they were in direct contact, why the tolerances in the production do not need to be as high as if they were not spaced apart. It should be observed, of course, that the spacing apart could be enabled by having a non magnetic material at respectively end of the plunger 61 instead of encapsulating the ferromagnetic element 66, 67 in the valve seats 64, 65. If the distancing insulating material is too thin, there is a risk that it will wear off whereby the magnetic force would increase drastically. Preferably, the distancing material is a polymer having a thickness in the range of 0.3-3 mm, more preferably 0.5-2 mm.

The plunger 61 preferably is cylindrical and has a diameter in the range of 2-12 mm, more preferred 3-8 mm, and preferably it has a length that is larger than its diameter.

The electromagnetically operating means 68*a*, 68*b* are provided by two solenoid coils 68*a*, 68*b* wound around the axially extending chamber 63 of the valve body 73. The solenoid coils 68*a*, 68*b* are wound in opposite winding directions to each other, where a first one 68*a* of the two solenoids coils 68*a*, 68*b* is for snapping the plunger from the rearward position to forward position, and a second one 68*b* of the two solenoids is for snapping from forward position to rearward position. Of course, it would be possible to have one or more solenoid coils 68*a*, 68*b* wound in the same direction, and instead switching the direction of the current to snap the plunger 61 between the two positions. It should be observed that the solenoid coils 68*a*, 68*b* do not need to be energized to hold the plunger 61 at anyone of the two stable positions, thus the fuel valve 60 is bistable.

Preferably the fuel valve 60 is arranged to be set in a closed state when the engine is stopped, i.e. a state for which the plunger is resting at the front valve seat 64. This has the advantage of preventing any leakage of fuel from the carburetor when a tool including the carburetor is not in use. However, when attempting to start the engine after a storage period, remaining oil may cause the plunger to get stuck in the closed state and the energy provided by the solenoid coils 68*a*, 68*b* when attempting to start may be insufficient to move the plunger 61 to the open state. Furthermore, the suction pressure from the outlet port 71, when pulling the starting cord, will suck the plunger 61 towards the front valve seat 64, not helping to release the plunger 61 from its closed state. This problem can be resolved by wetting the interior of the fuel valve with fuel dissolving any clogging oil. Therefore according to the embodiment shown in FIG. 3, the fuel valve, or more specifically, the valve body 73, is provided with a pump port 75, which is located adjacent the first and second ports 71, 72 at the front end of the valve body 73 and in communication with the second or inlet port 72 through the fuel cavity 74. The pump port 75 is fluidly connected to the second or inlet port 72 regardless of the position of the plunger 61.

In the embodiment shown in FIG. 5, the fuel line 80*a* is connected to the pump port 75, and the manually operated pump is a purge pump 81*a*, preferably of the type having an elastic bulb. The upstream check valve 82 is arranged in the fuel line 80*a* at a position between the pump port 75 and the purge pump 81*a*, and the downstream check valve 83 is arranged in the fuel line 80*a* at a position between the purge pump 81*a* and the fuel tank 26. Upon operation of the purge pump 81*a* by squeezing the purge bulb, fuel remaining inside the pump is returned through a portion of the fuel line 80*a* to the fuel tank 26. When releasing the compression, the purge bulb expands creating an internal negative pressure, which draws fuel and possibly air from the inlet port 72 through the cavity 74 and the pump port 75 and into the purge pump 81*a*. Thereby, fresh fuel flows past and dissolves the possible oil residue that causes sticking and clogging between movable parts and possibly even blocking of small fuel bores. Then, the procedure is repeated once or more times to ensure that no harmful air or oil residue is left inside the fuel valve 60. The pump port 75 is especially useful when the fuel valve 60 being arranged to be normally closed at startup, but also carburetors having fuel valves that are arranged to be partly or fully open at start up can benefit from having a pump port 75 provided in the fuel valve.

In the embodiment shown in FIG. 6, the fuel valve 60 has no pump port 75. Instead, the fuel line 80*a* is connected to fuel conduit 37 which extends from the outlet port 71 of the fuel cavity 74 towards the nozzles 35, 36 in the main air passage 21 of the carburetor, i.e. at a position downstream the fuel valve 60 but upstream the check valves 84, 85. This embodiment is suitable if the fuel valve 60 is not fully closed at start up, i.e. having the plunger 61 in a position where it does not seal against the valve seat 64, or alternatively, if having a leak passage (not shown) for permitting a minor leakage of fuel between the fuel cavity 74 and the fuel conduit 37 downstream of the valve 60. This embodiment has the advantage that fuel is drawn further downstream, i.e. closer to the main air passage 21, which may reduce the average number of pulls required by a user starting the engine.

The air purging embodiments of FIGS. 5 and 6 may be combined with a priming function as e.g. the one described in U.S. Pat. No. 7,690,342, where at least a part of the fuel drawn through the carburetor due to the purge pressure is supplied directly to the main air passage 21 and/or to the crank case instead of returning it to the tank 26.

Figure 11:
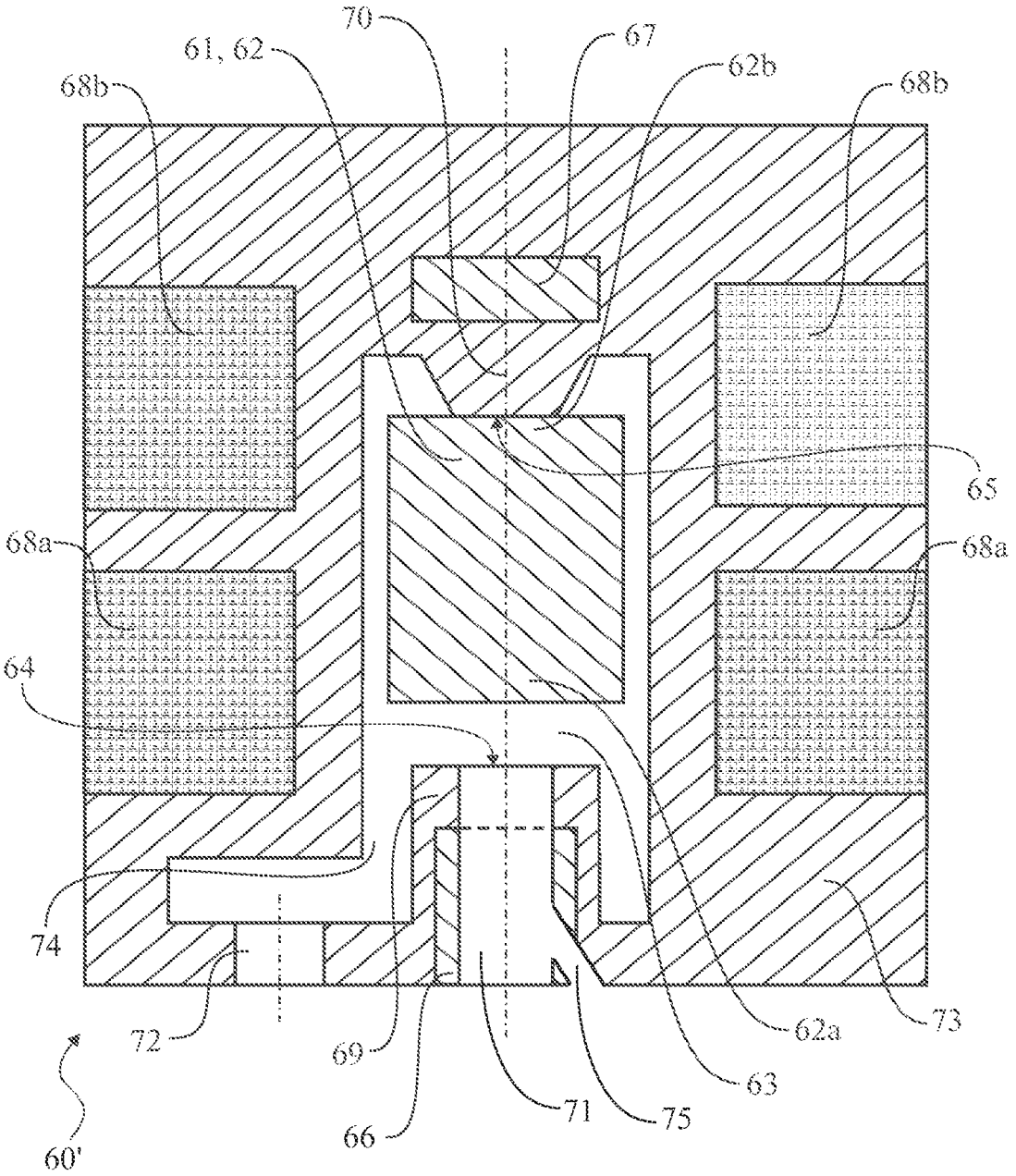
FIG. 11 is a schematic cross sectional view of a fuel valve having a port for connection to the primer system shown in FIG. 7.

FIG. 7 shows a third embodiment basically similar to the one in FIG. 5, but has a manually operated primer pump 81*b*, preferably by turning the direction of check valves. i.e. by connecting the downstream check valve 82 towards the fuel tank 26 and the upstream check valve 83 towards the fuel valve 60'. The fuel valve 60' is preferably of the kind disclosed in FIG. 11, which is similar to the fuel valve designated 60, but differs in that the pump port 75 has been moved from directly communicating with the fuel cavity and instead communicating with a passage of the outlet port 71 provided downstream of the front valve seat 64. By directing the pump port 75 towards the opening at the front valve seat 64 and provided that the fuel pressure applied by the priming operation is large enough, fuel can flow through the valve irrespective of whether it is normally open or closed. Thereby, fresh fuel flows past and dissolves the possible oil residue that causes sticking and clogging between movable parts and possibly even blocking of small fuel bores at the same time as fuel is ejected at least through the main nozzle 36 to provide the desired priming effect. Then, if necessary, the procedure is repeated once or more times to ensure that no harmful air or oil residue is left inside the fuel valve 60. Of course, if the plunger 61 is in a position not closing the fuel valve 60 or there is a leak flow arranged also for the closed state of the fuel valve, fuel can more easily flow through the fuel valve. Since the fuel line 80*b* here connects to the fuel conduit 37 downstream the fuel valve 60, the upstream check valve 83 may be subjected to significant under pressures from the main air passage 21 when the fuel valve 60 is closed. Therefore, the check valve 83 in this embodiment is preferably of a kind with a spring loaded 86 ball to help keep it shut. However, other kinds of check valves that can resist the under pressure from the main passage 21 could also be used. In an alternative embodiment the primer pump 81*b* may be connected directly to the fuel cavity 74 by using the fuel valve 60 of FIG. 3. Here the fuel cavity 74 is wetted regardless of if the plunger 61 is in its closed or open state.

In the embodiment shown in FIG. 8 the fuel valve 60 has no pump port 75. Instead the manually operated primer pump 81*b*, preferably of the type having an elastic bulb, is connected via the fuel line 80*b* to the fuel conduit 37 downstream of the fuel valve 60 but upstream the check valves 84, 85. The fuel conduit 37 extends from the outlet port 71 of the fuel cavity 74 towards the nozzles 35, 36 in the main air passage 21 of the carburetor. In this embodiment the primer pump 81*b* is preferably operated when the plunger 61 is in a position where it does not seal against the valve seat 64, or a leak passage (not shown) is provided for permitting a minor leakage of fuel between the fuel cavity 74 and the fuel conduit 37 downstream of the valve 60. Alternatively or in addition, the restriction caused by the main nozzle 36 is selected to be sufficiently large to create a counter pressure, so that fuel upon operation of the primer pump 81*b* can flow through the valve irrespective of whether it is normally open or closed, provided that the fuel pressure is large enough. Since the fuel line 80*b* here connects downstream the fuel valve 60, the upstream check valve 83 may be subjected to significant under pressures from the main air passage 21 when the fuel valve 60 is closed. Therefore, the check valve in this embodiment is preferably of a kind with a spring loaded 86 ball to help keep it shut. However, other kind of check valves that can resist the under pressure from the main passage 21 could also be used.

In the embodiment of FIG. 9 the fuel valve 60 has no pump port 75. Instead the manually operated primer pump 81*b*, preferably of the type having an elastic bulb, is connected via the fuel line 80*b* to the fuel metering chamber 28 of the fuel regulator 29, i.e. upstream of the fuel valve 60. Alternatively it can be connected to the fuel duct 31. This embodiment functions best if the fuel valve 60 is partly or fully open when starting the engine, since the fuel flow from the primer pump in that case will push trapped air through the fuel valve 60 towards the main and idle nozzles 35, 36.

The embodiments of FIGS. 7-9 may be combined with additional priming functions. E.g. in addition to supplying fuel into the fuel valve 60, fuel can be supplied directly to the main air passage 21 and/or to the crank case.

Figure 10:
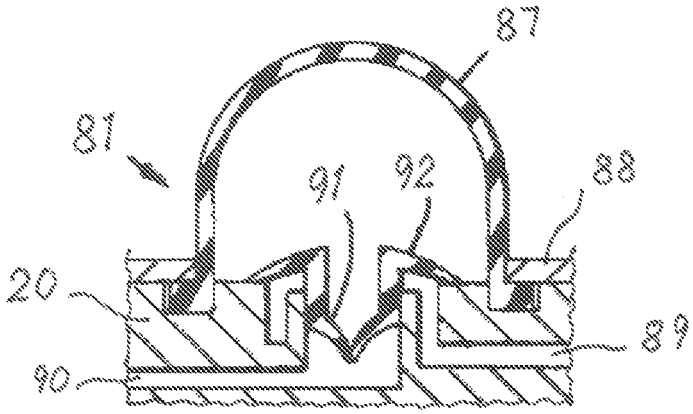
FIG. 10 is a cross sectional view of a purge pump used in FIGS. 5 and 6 or a primer pump used in FIGS. 7, 8 and 9.

A simple embodiment of a pump 81 for purging or priming is shown in FIG. 10. The pump 81 includes an elastic bulb 87, which is attached to the carburetor 20, e.g. by the shown mounting arrangement 88. The carburetor 20 has an inlet conduit 89 and an outlet conduit 90, both of which open in the interior space defined by the bulb 87. The opening of the inlet conduit 89 is shown to surround that of the outlet conduit 90, and the latter is comparatively wide to hold a double check valve member. The shown double check valve member has an outlet valve 83 in the shape of a central duckbill valve 91 seated in the opening of the outlet conduit 90 and surrounded by an integral generally annular membrane valve 92 covering the opening of the inlet conduit 89 and forming the inlet check valve 82. When the operator squeezes the bulb 87, fuel will be pressed out between the lips of the duckbill valve 91, and when he releases the bulb 87, the duckbill valve 91 will close and the negative pressure created inside the bulb 87 will open the annular membrane valve 92 and draw fuel through the inlet conduit 89 to fill the bulb 87.

Whereas the invention has been shown and described in connection with the preferred embodiments thereof it will be understood that many modifications, substitutions, and additions may be made which are within the intended broad scope of the following claims. From the foregoing, it can be seen that the present invention accomplishes at least one of the stated objectives.

For instance, even though the fuel valves 60 described above are bistable fuel valves, other fuel valves could be used. For instance the fuel valve could be a mono-stable fuel valve, i.e. where the valve member has only one stable position when not energized. In such case the stable position is preferably a position where the moveable valve member rests against the front valve seat of the fuel valve, i.e. when in the stable position the fuel valve is preferably closed. Furthermore, other means of providing stable positions when not energized than that of magnetic attraction could be used, for instance, a spring urging the moveable valve member toward a certain position. Also fuel valves lacking stable positions when not energized could be used. Furthermore, instead of having an electrically operated fuel valve, the fuel valve could be a mechanically controlled fuel valve.

For instance, the fuel valve 60 could be an integral part of the carburettor or being a separate unit connecting inlet and outlet ports to openings on the carburettor body, i.e. one opening leading to the fuel regulator and another one towards the main and idle nozzles.

For instance, the upstream check valve 82 of the purging pump 81*a* and the downstream check valve 83 for the purging pump 81*b* are preferably placed close to where the fuel line 80 connects to the ordinary fuel supply system (e.g. at the connection point at the fuel valve 60, the fuel conduit 37, the duct 31, or the fuel regulator 39 depending on embodiment). Alternatively the fuel line 80 may have additional check valves where the fuel line 80 connects to the ordinary fuel supply system.

INDUSTRIAL APPLICABILITY

The present invention is especially applicable for use in connection with air purging during the starting of hand-held power-tools such as, but not limited to, chain saws and line trimmers, which as a rule are powered by small two-stroke internal combustion engines that are equipped with diaphragm carburetors.

The invention claimed is:

1. A fuel valve for controlling delivery of fuel to a main air passage of a carburetor of an internal two stroke combustion engine, the fuel valve comprising:

a fuel inlet port for receiving fuel from a fuel regulator of the carburetor, a fuel outlet port for connecting to at least one nozzle in the air passage leading into the engine, a fuel cavity disposed within a valve body of the fuel valve and between the fuel inlet port and the fuel outlet port of the fuel valve, a pump port in communication with the fuel cavity of the fuel valve, wherein said pump port is connected to a pump via a fuel line to the fuel tank;

a plunger movable within a chamber of the fuel cavity along a longitudinal axis of the chamber between two states:

a first state where the plunger is positioned to permit the fuel to flow from the fuel inlet port of the fuel valve through the fuel cavity through the fuel outlet port of the fuel valve and through the pump port of the fuel valve, and a second state where the plunger is positioned to block the fuel from flowing through the fuel outlet port and permit the fuel to flow, due to operation of the pump, into the chamber of the fuel cavity and through the pump port to wet interior surfaces of the chamber of the fuel cavity that interface with the plunger while fuel flow through the outlet port is blocked by the plunger.

2. The fuel valve according to claim 1, wherein the pump is a purge pump configured to draw the fuel through the fuel inlet port, through the fuel cavity, and out the pump port.

3. The fuel valve according to claim 1, wherein the pump is a primer pump configured to inject the fuel into the fuel cavity from the fuel tank.

4. The fuel valve as claimed in claim 1, wherein the fuel inlet port, the fuel outlet port, and the pump port are located at a front end of the chamber;

wherein a first ferromagnetic element is disposed near a rear end of the chamber on the longitudinal axis;

wherein a second ferromagnetic element is disposed near the front end of the chamber;

wherein, in the first state, the plunger is positioned along the longitudinal axis at the rear end of the chamber and is acted upon by a first magnetic force exerted by the first ferromagnetic element, and wherein, in the second state, the plunger is positioned along the longitudinal axis at the front end of the chamber to block the fuel outlet port and is acted upon by a second magnetic force exerted by the second ferromagnetic element.

5. The fuel valve according to claim 1, wherein one of the two states is a stable state, wherein in the stable state the fuel valve is energized to move the plunger from the stable state.

6. The fuel valve according to claim 1, wherein the fuel valve is an integral part of the carburetor.

7. The fuel valve according to claim 1, wherein the fuel valve is connected to the exterior of the carburetor.

8. The fuel valve according to claim 1, wherein the pump is a purge pump, wherein an upstream check valve is arranged in the fuel line at a position between the pump port of the fuel valve and the purge pump, and wherein a downstream check valve is arranged in the fuel line at a position between the purge pump and a fuel tank.

9. The fuel valve according to claim 1, wherein the pump is a primer pump.

10. The fuel valve according to claim 1, wherein the fuel outlet port extends to a main air passage of the carburetor.

11. A fuel supply system of an internal two stroke combustion engine comprising:

a carburetor with a main air passage, the carburetor having a fuel pump supplying fuel to a fuel regulator from a fuel tank, and a fuel valve including:

a fuel inlet port for receiving fuel from the fuel regulator of the carburetor, a fuel outlet port for connecting to at least one nozzle in the air passage leading into the engine, a fuel cavity disposed within a valve body of the fuel valve and between the fuel inlet port and the fuel outlet port of the fuel valve, a pump port in communication with the fuel cavity of the fuel valve, wherein said pump port is connected to a second pump via a fuel line to the fuel tank, and a plunger movable within a chamber of the fuel cavity along a longitudinal axis of the chamber between two states:

a first state where the plunger is positioned to permit the fuel to flow from the fuel inlet port of the fuel valve through the fuel cavity through the fuel outlet port of the fuel valve and through the pump port of the fuel valve, and a second state where the plunger is positioned to block the fuel from flowing to the fuel outlet port and permit the fuel to flow, due to operation of the second pump, into the chamber of the fuel cavity and through the pump port to wetting interior surfaces of the chamber of the fuel cavity that interface with the plunger while fuel flow through the outlet port is blocked by the plunger, wherein the second pump comprises a purge pump that communicates with the fuel valve to permit the purge pump to deliver the fuel from the fuel inlet port of the fuel valve through the fuel cavity and the pump port of the fuel valve and return the fuel to the fuel tank, or the second pump comprises a primer pump that communicates with the fuel valve to permit the primer pump to deliver the fuel from the fuel tank through the pump port into the fuel cavity of the fuel valve.

12. The fuel supply system according to claim 11, wherein a first and a second check valve are provided in the fuel line with the purge pump or the primer pump, wherein the first and the second check valves are arranged to allow and direct a fuel flow from the fuel tank towards the carburetor in case of the primer pump, and wherein the check valves are arranged to allow and direct the fuel flow from the carburetor towards the fuel tank in case of the purge pump.

13. The fuel supply system according to claim 11, wherein a third and a fourth check valve are provided downstream of the fuel valve or downstream of the position where the fuel line connects to a fuel conduit, the fourth check valve being provided in a conduit leading to a main nozzle and the third check valve being provided in a branch conduit leading to at least one idle nozzle.

14. The fuel supply system according to claim 11, wherein the fuel supply system is provided in a hand held tool powered by the engine, the engine being a two stroke crank case scavenged internal combustion engine.

15. The fuel supply system according to claim 11, wherein the pump port is fluidly connected to the fuel inlet port regardless of the state of the plunger.

16. The fuel supply system according to claim 11, wherein the second pump comprises a bulb, an inlet conduit and an outlet conduit, wherein fuel exits the bulb via the outlet conduit responsive to an operator squeezing the bulb, and wherein fuel enters the bulb via the inlet conduit responsive to the operator releasing the bulb.

17. A method for facilitating starting of an internal combustion two stroke engine including a carburetor with a main air passage, the carburetor having a fuel pump supplying fuel to a fuel regulator from a fuel tank, said fuel supply system further including a fuel valve, wherein the fuel valve comprises:

a fuel inlet port for receiving fuel from the fuel regulator of the carburetor, a fuel outlet port for connecting to at least one nozzle in the air passage leading into the engine, a fuel cavity disposed within a valve body of the fuel valve and between the fuel inlet port and the fuel outlet port of the fuel valve, a pump port in communication with the fuel cavity of the fuel valve, wherein said pump port is connected to a second pump via a fuel line to the fuel tank, and a plunger movable within a chamber of the fuel cavity along a longitudinal axis of the chamber between two states:

a first state where the plunger is positioned to permit the fuel to flow from the fuel inlet port of the fuel valve through the fuel cavity through the fuel outlet port of the fuel valve and through the pump port of the fuel valve, and a second state where the plunger is positioned to block the fuel from flowing to the fuel outlet port and permit the fuel to flow, due to operation of the second pump, into the chamber of the fuel cavity and through the pump port to wet interior surfaces of the chamber of the fuel cavity that interface with the plunger while fuel flow through the outlet port is blocked by the plunger, and wherein the second pump comprises a purge pump that communicates with the fuel valve to permit the purge pump to deliver the fuel from the fuel inlet port of the fuel valve through the fuel cavity and through the pump port of the fuel valve returning the fuel to the fuel tank;

wherein the method comprises:

moving the plunger into the second state; and operating the purge pump to deliver the fuel from the fuel inlet port of the fuel valve through the fuel cavity and through the pump port of the fuel valve for return to the fuel tank to wet the interior surfaces of the chamber of the fuel cavity that interface with the plunger while fuel flow through the outlet port is blocked by the plunger.

18. A method for facilitating starting of an internal combustion two stroke engine including a carburetor with a main air passage, the carburetor having a fuel pump supplying fuel to a fuel regulator from a fuel tank, said fuel supply system further including a fuel valve, wherein the fuel valve comprises:

a fuel inlet port for receiving fuel from the fuel regulator of the carburetor, a fuel outlet port for connecting to at least one nozzle in the air passage leading into the engine, a fuel cavity disposed within a valve body of the fuel valve and between the fuel inlet port and the fuel outlet port of the fuel valve, a pump port in communication with the fuel cavity of the fuel valve, wherein said pump port is connected to a second pump via a fuel line to the fuel tank, and a plunger movable within a chamber of the fuel cavity along a longitudinal axis of the chamber between two states:

a first state where the plunger is positioned to permit the fuel to flow from the fuel inlet port of the fuel valve through the fuel cavity through the fuel outlet port of the fuel valve and through the pump port of the fuel valve, and a second state where the plunger is positioned to block the fuel from flowing through the fuel outlet port and permit the fuel to flow, due to operation of the second pump, into the chamber of the fuel cavity and through the pump port to wet interior surfaces of the chamber of the fuel cavity that interface with the plunger while fuel flow through the outlet port is blocked by the plunger, and wherein the second pump comprises a primer pump that communicates with the fuel valve to permit the primer pump to deliver the fuel from the fuel tank through the pump port into the fuel cavity of the fuel valve;

wherein the method comprises:

moving the plunger into the second state; and operating the primer pump to deliver the fuel from the fuel tank through the pump port into the fuel cavity of the fuel valve to wet the interior surfaces of the chamber of the fuel cavity that interface with the plunger while fuel flow through the outlet port is blocked by the plunger.

* * * * *